US006397536B1

(12) United States Patent
Morello

(10) Patent No.: US 6,397,536 B1
(45) Date of Patent: Jun. 4, 2002

(54) METHOD AND APPARATUS FOR CONNECTING A BUILDING PANEL TO A FOUNDATION

(75) Inventor: Frederick Morello, Johnstown, PA (US)

(73) Assignee: MIC Industries, Reston, VA (US)

( * ) Notice: Subject to any disclaimer, the term of this patent is extended or adjusted under 35 U.S.C. 154(b) by 0 days.

(21) Appl. No.: 09/612,366

(22) Filed: Jul. 7, 2000

(51) Int. Cl.[7] ..... E02D 19/00

(52) U.S. Cl. ..... 52/274; 52/293.1; 52/294; 52/274

(58) Field of Search ..... 52/302.3, 274, 52/220.1, 169.8, 294, 298, 293.3, 258, 281, 290, 169.5, 576; 249/4, 22, 34, 36, 193; 405/287

(56) References Cited

U.S. PATENT DOCUMENTS

| | | | | | |
|---|---|---|---|---|---|
| 899,185 | A | | 9/1908 | Purdy | |
| 1,015,429 | A | | 1/1912 | Fahrney | |
| 1,531,239 | A | * | 3/1925 | McCollum | |
| 2,548,343 | A | * | 4/1951 | Brown | 25/131 |
| 2,776,463 | A | * | 1/1957 | Lankford | 25/118 |
| 3,226,935 | A | * | 1/1966 | Schneller | 61/49 |
| 3,420,016 | A | * | 1/1969 | Findlay | 52/221 |
| 3,743,232 | A | * | 7/1973 | Vaughan | 249/34 |
| 4,364,253 | A | | 12/1982 | Knudson | 72/187 |
| 4,470,186 | A | | 9/1984 | Knudson | 29/243.5 |
| 4,505,084 | A | | 3/1985 | Knudson | 52/528 |
| 4,505,143 | A | | 3/1985 | Knudeon | 72/187 |
| 4,678,156 | A | * | 7/1987 | Scalamandre et al. | 249/34 |
| 4,783,935 | A | | 11/1988 | Creager | 52/98 |
| 4,875,808 | A | * | 10/1989 | Kellison | 405/244 |
| 5,243,748 | A | | 9/1993 | Morello | 29/243.5 |
| 5,249,445 | A | | 10/1993 | Morello | 72/9 |
| 5,318,236 | A | | 6/1994 | Morello et al. | 242/72 |
| 5,359,871 | A | | 11/1994 | Morello | 72/7 |
| 5,393,173 | A | | 2/1995 | Morello | 405/151 |
| 5,469,674 | A | | 11/1995 | Morello | 52/86 |
| 5,475,950 | A | * | 12/1995 | Palmer | 52/169.5 |
| 5,584,198 | A | | 12/1996 | Morello et al. | 72/8.3 |
| 5,604,966 | A | | 2/1997 | Morello et al. | 29/243.58 |
| 5,623,805 | A | | 4/1997 | Morello | 52/749.1 |
| 5,924,264 | A | * | 7/1999 | Vierra | 52/741.15 |
| 5,956,911 | A | * | 9/1999 | Kistner et al. | 52/302.3 |
| 5,960,662 | A | | 10/1999 | Morello | 72/166 |
| 5,966,791 | A | | 10/1999 | Morello et al. | 29/243.5 |
| 5,980,156 | A | | 11/1999 | Morello et al. | 405/151 |
| 6,018,917 | A | | 2/2000 | Leek | 52/250 |

* cited by examiner

*Primary Examiner*—Carl D. Friedman
*Assistant Examiner*—Basil Katcheves
(74) *Attorney, Agent, or Firm*—Blaney Harper; Jones, Day, Reavis & Pogue

(57) ABSTRACT

The present invention is a method and apparatus for improving the connection between a building panel and a foundation. The improved connection is made possible by a unique form assembly that includes a trough assembly and a novel means for adequately supporting the trough assembly while the concrete is poured. The trough assembly creates a trough, which is an elongated hollow notch at the top of the foundation that resembles the shape of the trough assembly. Thus, the trough assembly is designed such that its width is approximately equal to the width of the building panel. The trough assembly also includes an angle iron affixed to the top of its sides. The trough assembly provides the building panel an elongated hollow groove having angle irons on each side. The prefabricated panel is therefor affixed to the angle irons. Placing the prefabricated panel in the foundation in such a manner and affixing it to the angle irons provides the panel with improved lateral and horizontal support. Moreover, the building panel is placed in the trough after the concrete foundation is poured, and placing the building panel in the foundation after it is poured rather than before it is poured reduces the building panels exposure to undesirable stresses caused by the pouring and curing of the concrete.

7 Claims, 5 Drawing Sheets

METHOD AND APPARATUS FOR CONNECTING A BUILDING PANEL TO A FOUNDATION

TECHNICAL FIELD

This invention relates to a method and apparatus for connecting a building panel to a foundation, and more particularly, a unique form assembly that includes a trough assembly, which remains in the foundation after the concrete foundation cures, thereby improving the connection between the building panel and the foundation.

BACKGROUND ART

Most buildings are constructed of a combination of columns (i.e., posts) and beams, which are covered by plywood or some sort of metal or plastic sheeting. In an effort to reduce the overall construction time, however, contractors often construct buildings, and particularly, the exterior walls of certain types of buildings, with prefabricated building panels. Constructing a building with such panels increases efficiency because rather than assembling individual components on site, entire wall panels are manufactured on the construction site so that they can swiftly be combined and installed. These prefabricated panels are typically manufactured from steel sheet metal such that when placed adjacent to one another, the sides of two panels matingly engage and form a sealed joint. The bottom of the panels are affixed to a foundation, and the pattern is repeated until the desired design building length or width is achieved.

Although utilizing prefabricated building panels reduces the construction time, all of the prefabricated panels are not typically erected in one day. Rather, constructing the entire framework of a building engineered from prefabricated building panels requires a number of days and often weeks to complete. During this time, the only support for the panel may be the connection between it and the foundation. Moreover, during the construction phase, the panel may be exposed to various weather conditions, which impart undesirable lateral and vertical forces on the panel.

For example, a building panel may experience certain lateral forces caused by the wind and snow. Particularly, when the wind blows against a building panel, the wind pushes the building panel in a certain direction, thereby creating lateral forces and moments thereon. These moments, in turn, create uplift (i.e., tensile) and compression forces on the bottom of the panel. The tensile and compression forces eventually transfer to the foundation. If such forces exist for a prolonged period, the foundation or individual panels may become fatigued and ultimately fail. Moreover, if construction occurs during the winter and snow falls upon a partially constructed roof that is supported by a prefabricated building panel, the building panel will experience similar forces and moments as those created by the wind because the weight of the snow will begin to deflect the panel.

The connection between the prefabricated building panel and the foundation, therefore, becomes the focal point when determining whether the building panel can withstand the necessary resistive forces to combat the undesirable weather conditions during construction. One method of connecting a building panel to a concrete foundation includes affixing an angle iron, such as an elongated "L" shaped piece of metal to the bottom of the prefabricated panels. The two are affixed by either being welded, brazed, bolted, etc. Thereafter, the elongated angle iron, itself, is affixed to one or a series of transverse cross members. The panel, angle iron and cross member assembly is then placed within a form and a concrete foundation is poured over such assembly.

The art of constructing foundations is well known and typically includes pouring fluent concrete into a form assembly. The form assembly typically includes two substantially parallel, elongated panel walls and a means for resisting the outward, hydrostatic forces created by the fluent concrete as it is poured between the walls. Such means insures that the panel walls remain at a predetermined gap while the concrete hardens (i.e., cures). Once the concrete hardens, the form panel walls are removed, and earth is moved to surround the foundation, thereby reinforcing it.

When the building assembly is situated within the form, fluent concrete is poured into the form and over the assembly such that the connection between the three components is buried within the concrete. Embedding the assembly within the foundation may, however, impart undesirable stresses upon the building panel, angle iron, and cross members. Specifically, it is important that the building panels maintain their accurate alignment during the construction phase because the building panels represent the exterior wall of the building and the exterior walls must be accurately aligned. As the concrete hardens, however, it may create a force and/or moment on the building panel, which, in turn, could cause it to deflect and/or warp, thereby becoming misaligned.

Furthermore, merely placing the assembly between the two side panels of the form assembly does not provide the assembly with sufficient support while the concrete is being poured into the form. Particularly, placing the assembly within the form does not provide it with any lateral or horizontal support. Moreover, the pressure with which the concrete enters the form assembly often causes the panel to shift, thereby increasing the likelihood that the building panels will be unable to maintain their accurate alignment.

Thus, what is needed is a method and apparatus for improving the method of connecting a prefabricated building panel to a foundation so that the building panel may have increased ability to maintain its alignment and withstand the resistive forces created by undesirable weather conditions.

DISCLOSURE OF INVENTION

The present invention is a method and apparatus for improving the connection between a building panel and a foundation. The improved connection is made possible by a unique form assembly that includes a trough assembly and a novel means for adequately supporting the trough assembly while the concrete is being poured. The trough assembly not only forms a trough within the foundation, but also becomes an integral part of the foundation after the concrete hardens. The trough assembly includes angle irons that are exposed at the surface of the completed foundation. A prefabricated panel sits between the angle irons within the trough assembly, and the prefabricated panel is welded to the angle irons, thereby improving the building panel's lateral and horizontal support and its ability to withstand resistive forces. More importantly, the building panel is placed in the foundation after the foundation is poured rather than before the foundation is poured, thereby reducing the building panels exposure to undesirable stresses caused by the pouring and curing of the concrete.

The trough is an elongated hollow notch at the top of the concrete foundation that resembles the shape of the trough assembly. The trough assembly is designed (i.e., configured) such that its width is approximately equal to the width of the building panel. Similarly to pouring the concrete over assembly of the building panel, angle iron, and cross member, placing the building panel in the trough assembly allows the building panel to sit within the foundation rather than above it. Unlike the assembly, however, the trough assembly is supported by the form assembly to reduce the possibility of subjecting the form assembly to undesirable forces and stresses that could eventually cause it to become warped and misaligned.

Moreover, the trough assembly provides for an improved connection between the building panel and the foundation because the building panel is placed within the trough after the foundation is poured. Delaying placement of the prefabricated building panel into the trough until after the foundation hardens prevents the building panel from being subject to the undesirable forces and stresses created when the concrete hardens. Rather, if any such forces or stresses are created, the trough assembly must endure them rather than the building panel.

The connection between the foundation and the building panel is also improved by buttressing the portion of building panel above the foundation. Specifically, the method of the present invention includes adding a support structure above and adjacent to the trough assembly, thereby increasing the width of the building panel so that it extends over the trough. One such buttressing means includes a transverse cross member that extends into either or both side(s) of the building panel such that the cross member is adjacent to the top of the trough assembly. Placing the panel within a trough, along with buttressing the portion above the foundation, allows the assembly to withstand greater reaction forces, thereby improving the connection between the panel and the foundation. The connection may also be further improved by welding the transverse cross member to the panel and/or forming a concrete cap over such support structure.

Accordingly the present invention relates to a form assembly, comprising two substantially parallel side panels, each panel having an opening therethrough, a "U" shaped trough assembly located between the side panels, the trough assembly comprising two upright portions and a base portion, each of the upright portions having an opening therethrough, the openings of the upright portions being horizontally and vertically aligned with one another, at least one support beam extending through the openings of the side panels and the openings of the upright portions of the trough assembly, the support beam being substantially perpendicular to the side panels and the side upright portions.

The present invention also relates to a method for constructing a foundation, comprising the steps of pouring fluent concrete in a form assembly comprising two substantially parallel side panels, each panel having an opening therethrough, a up shaped trough assembly located between the side panels, the trough assembly comprising two upright portions and a base portion, each of the upright portions having an opening therethrough, the openings of the upright portions being horizontally and vertically aligned with one another and at least one support beam extending through the openings of the side at panels and the openings of the upright portions of the trough assembly, the support beam being substantially perpendicular to the side panels and the side upright portions, such that the fluent concrete is poured between the trough assembly and the side panels, removing the support beam, and allowing the concrete to cure.

The present invention further relates to an assembly for connecting a building panel to a foundation, comprising a foundation having a trough, the trough having two substantially parallel elongated vertical sides and an elongated horizontal floor, a trough assembly comprising two upright walls adjacent the corresponding vertical sides of the trough, each of the upright walls comprising a top end and a bottom end, a base portion atop the floor of the trough and connecting the bottom ends of the upright walls and elongated angle irons aligned with and attached to the top end of the upright walls, at least of portion of the elongated angle irons protruding though the foundation, and a building panel having a width and two sides, the width of the building panel being approximately equal to the width of the base portion of the trough assembly, the building panel located within the trough assembly such that the sides of the building panels are adjacent the upright walls of the trough assembly and the sides of the building panels are connected to the angle irons on the corresponding sides.

The present invention even further relates to a method for erecting a building panel, the building panel having two sides and a width, the method comprising the steps of forming a foundation having a trough, wherein the width of the base of the trough is approximately equal to the width of the building panel, the step of forming the foundation comprising the steps of pouring fluent concrete in a form assembly comprising two substantially parallel side panels, means for preventing said side panels from extending outward, a trough assembly located between the side panels, the trough assembly comprising two elongated upright walls each having a top end and a bottom end, a base portion connected to the bottom ends of the elongated upright walls, and elongated angle irons aligned with and attached to the top ends of the elongated upright walls, pouring fluent concrete such that the fluent concrete is poured between the trough assembly and the side panels to a level such that at least a portion of the angle irons remain exposed above the concrete, and allowing the concrete to cure, and placing one end of the building panel within the trough, and connecting the at least one of the angle irons to said building panel.

The foregoing features and advantages of the present invention will become more apparent in light of the following detailed description of exemplary embodiments thereof as illustrated in the accompanying drawings.

BEST MODE FOR CARRYING OUT THE INVENTION

Figure 1:
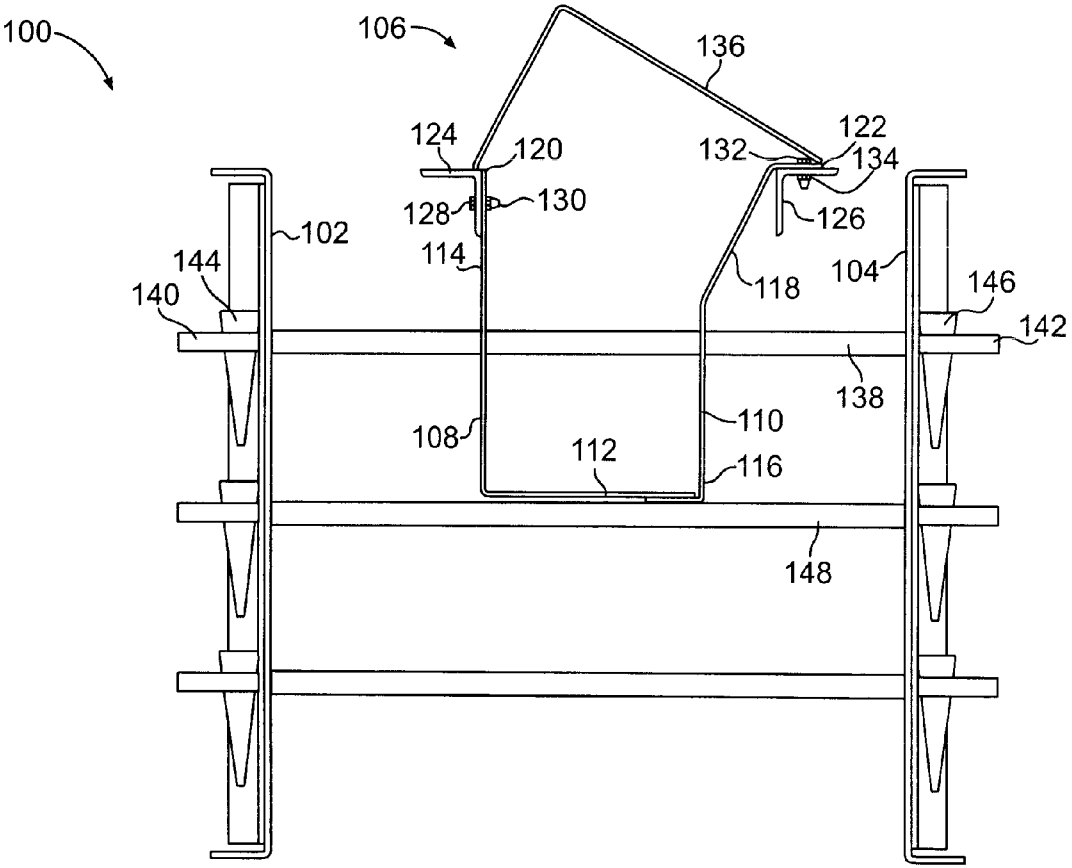
FIG. 1 illustrates a form assembly according to one embodiment of the present invention that comprises a trough assembly disposed and supported by and between two substantially parallel side wall panels.

Referring to FIG. 1, there is shown a form assembly 100 of the present invention. The form assembly 100 comprises a "U" shaped trough assembly 106 disposed between two substantially parallel side panels 102, 104 and supported by at least one support beam 138. Upon pouring the concrete into the form assembly 100, a trough will be formed. The trough will resemble the trough assembly 106 because the trough assembly 106 will remain within the foundation after the concrete is poured.

The trough assembly 106 comprises two upright wall portions 108, 110 and a base portion 112. It is also preferable that the upper portion 118 of the upright wall 110 be inclined such that a prefabricated building panel may be easily placed (i.e., installed) within the trough. Moreover, the width of the base portion 112 of the trough assembly 106 is sized accordingly such that it is approximately equal to the width of the prefabricated building panel. The trough assembly 106 may be a single fabricated piece of metal or it may be constructed of two overlapping components 114, 116, as illustrated in FIG. 1. Although the two components 114, 116 are preferably constructed of a light gauge stainless steel sheet metal, such components may also be fabricated from other comparable materials that provide adequate strength and erosion resistance.

The support beam 138 extends through an opening in each of the trough assembly's upright walls 108, 110 and through an opening in each of the side wall panels 102, 104. The support beam 138 not only supports the trough assembly 106 but also assists in resisting the outward hydrostatic forces created by the fluent concrete. Specifically, the support beam 138 includes slotted ends 140, 142. Upon sliding the support beam 138 through the openings, wedges 144, 146 are inserted into the slotted ends 140, 142, respectively. Thus, as the fluent concrete is poured between the trough assembly 106 and the side wall panels 102, 104, the combination of the slotted support beam 138 and the wedges 144, 146 prevent the side wall panels 102, 104 from expanding, thereby maintaining a relatively constant gap between the panels 102, 104. An example of such a support beam 138 includes a slotted metal pipe. However, for the purposed of this disclosure, it shall be understood that the support beam 138 may be constructed of other types of similar structures and comparable materials.

The form assembly 100 may also include additional support beams that either extend through both the trough assembly 106 and the side wall panels 102, 104 or only through the side wall panels 102, 104. As shown in FIG. 1, it may be preferable to place an additional support beam 148 under the base portion of the trough assembly 106. Although the additional support beam 148 does not extend through the trough assembly 106, the additional support beam 148 is located underneath and adjacent to the trough assembly 106, thereby providing additional vertical support.

The form assembly 100 also includes an angle iron 124, 126 extending from the top ends 120, 122 of the upright wall portions 108, 110 of the trough assembly 106, respectively. Angle iron is typically an elongated piece or metal, such as iron, that has a general "L" shaped structure. Although most angle irons are constructed of corrosive metals, it is preferable that that angle iron be constructed of a non-corrosive material or coated with such a material. Each angle iron 124, 126 is affixed to the upright wall portions 108, 110 by respective nut 130, 134 and bolt 128, 132 assemblies.

As discussed in more detail below, the fluent concrete is poured into the form assembly 100 to a level approximately equal to the angle irons 124, 126. In an effort to minimize the amount of concrete that enters the trough assembly 106 it may be preferable to place a deflector shield 136 over the trough assembly 106. Moreover, it may be preferable for the deflector shield 136 to sit atop the angle irons 124, 126. The angle irons 124, 126 are affixed to the upright wall portions 108, 110 such that the angle irons 124, 126 extend therefrom.

Figure 2:
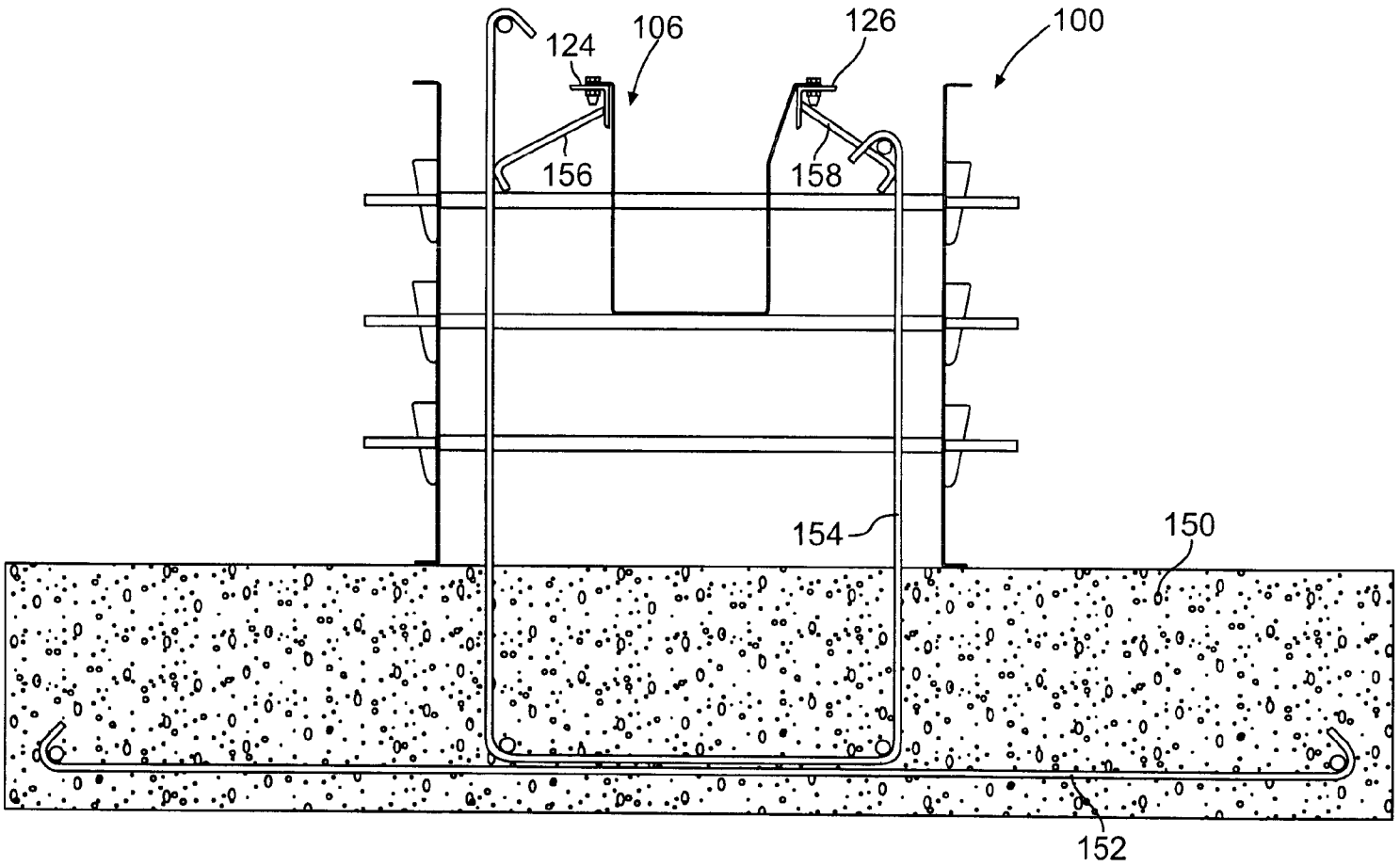
FIG. 2 illustrates the form assembly of FIG. 1 sitting atop a concrete footing.

Referring to FIG. 2, the form assembly 100 of FIG. 1 sits atop a footing 150 in order to create a foundation thereon. Although FIG. 2 illustrates a footing 150, it shall be understood that a foundation may also be constructed directly on the earth, on a preformed concrete block or on a pre-existing slab by placing the form assembly 100 atop such desired bases. It may also be preferable to incorporate reinforcement rods, which are typically referred to as "rebar", within the foundation 160 and footing 150 to increase the structural integrity of the foundation. For example, FIG. 2 illustrates a reinforcement rod 152 located horizontally along the lower portion of the footing 150. "U" shaped reinforcement rod 154 is embedded within the footing 150 and extends vertically into the form assembly 100. Additionally, reinforcement rods 156 and 158 are diagonally placed against the reinforcement rod 154 so as to contact the angle irons 124, 126. Furthermore, certain reinforcement rods may connect to other reinforcement rods such as reinforcement rods numbered 154 and 158. Although not shown, additional reinforcement rod configurations may be utilized to provide the desired strengthening effect.

Upon leveling the form assembly 100 on the footing 150, fluent concrete is poured into the form assembly 100. Specifically, the fluent concrete is poured between the trough assembly 106 and the side wall panels 102, 104. Moreover, it is preferable that the concrete rise to a level approximately equal to the angle irons 124, 126, such that the foundation is even with the top of the trough assembly 106, thereby leaving the angle irons 124, 126 exposed such that they slightly protrude from the top of the foundation. Leaving the angle irons 124, 126 exposed allows the building panel 168 to sit atop such angle irons 124, 126 and become affixed thereto.

In order to easily insert the building panel 168 into the trough within the hardened concrete foundation, it is preferable that the trough be free of obstructions. One means of insuring that the trough is free of obstructions includes removing the supporting beam 138, which extends through the trough assembly 106, from the form assembly 100 after the concrete is poured and before it hardens. However, most of the other supporting beams that do not extend through the trough assembly 106 are not removed at this time and remain in the form assembly 100 for an additional period. Specifically, it is important that at least some of the supporting beams remain in the form assembly 100 in order to resist the hydrostatic forces that are attempting to cause the side wall panels 102, 104 to expand.

Another means of means of insuring that the trough is free of obstructions includes leaving the supporting beam 138 in the form assembly 100 until after the concrete hardens and then removing via a cutting means. A further of means of insuring that the trough is free of obstructions includes inserting the supporting beam 138 at the longitudinal end of the form assembly 100 in a location such that the supporting beam 138 is not an obstruction. An even further means of insuring that the trough is free of obstructions includes merely supporting the trough assembly 100 with support beam 148, which is located underneath the trough assembly 100.

Figure 3:
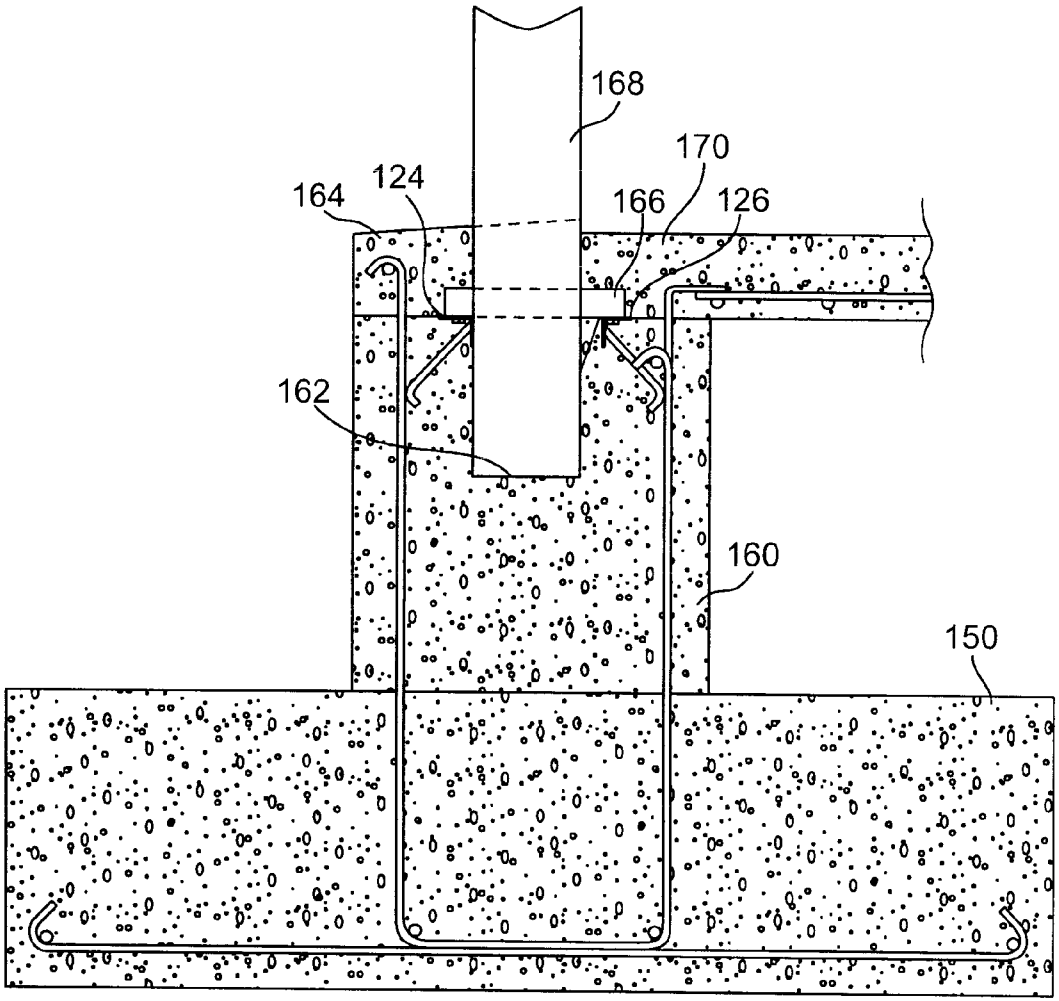
FIG. 3 illustrates a prefabricated building panel disposed in a trough and connected to a foundation constructed by the form assembly of the present invention. The building panel is connected to the foundation by inserting a transverse cross member through the building panel and pouring a concrete cap over the cross member.

Referring to FIG. 3, after the concrete hardens, the side wall panels 102, 104 are removed, thereby creating a concrete foundation 160 having a trough 162 at its top center. The trough 160 is formed by the "U" shaped trough assembly 106, which remained in the concrete after it hardened, thereby becoming an integral part of the foundation. The trough assembly 106 protects the concrete by forming a barrier between the building panel 168 and the foundation 160, thereby prolonging the foundation's useful life.

A prefabricated building panel 168 is thereafter placed within the trough 162 and extends upright therefrom. The trough 162 engages the prefabricated building panel 168 and envelopes it because the width of the building panel is equal to about the width (i.e., the base) of the trough. Placing the building panel 168 within the trough provides it with support to resist the lateral forces and moments. Specifically, rather than affixing the bottom of the building panel to the top of the foundation, as is typically done, the building panel 168 is embedded within the trough 162 of the foundation 160. Placing the building panel 168 in the trough 162 of the foundation 160 firmly supports the sides of building panel 168, as well as its base.

It is also preferable to affix the building panel 168 to the trough assembly 106, thereby increasing the building panel's support. Specifically, it is preferable to affix the side of the building panel 168 to the angle irons 124, 126 by welding the components together. It shall be understood that the present invention includes other mechanical and/or chemical means of affixing the building panel to the angle irons, such as bolting, riveting, bonding, etc.

When the wind blows and creates lateral forces at the top of one side of the building panel 168, a resistive force is required to oppose moment created by such wind created lateral force. The trough assembly 106, and particularly its wall portions 108, 110, apply the desired resistive forces to a side of the building panel 168 opposite that of the oncoming wind. The appropriate wall portion of the trough assembly 106, which is supported by the concrete foundation, absorbs the compressive stress created by the wind and imparts a responsive resistive force.

In comparison to affixing the base of a building panel to the top of the foundation, placing the building panel 168 in the trough 162 and affixing it to the trough assembly 106 insures that the concrete foundation will be subject to greater compressive forces rather than tensile forces. Subjecting the concrete to compressive stresses minimizes the tensile forces to which it is exposed, thereby reducing possibility that the concrete will become fatigued and crack. In other words, the present invention increases the building panel's lateral support, which in turn, improves the connection between the building panel 168 and the foundation 160. Additionally, placing the building panel within the trough allows the sides of the building panel to absorb and apply the resistive forces directly to the building panel rather than attempting to transfer such forces through a fastener located at the bottom of the building panel. Thus, the building panel is capable of withstanding increased lateral forces and moments, thereby improving the quality of the connection between the building panel 168 and the foundation 160.

Additionally, placing the building panel 168 in the foundation 160 after the concrete hardens rather than before it hardens increases the accuracy of the alignment of the building panels. The trough assembly 106 rather than the building panel 168 is embedded in the foundation 160, thereby subjecting the trough assembly 106 to any undesirable forces and stresses caused by the curing of the concrete. Postponing placement of the prefabricated building panel 168 into the trough until after the foundation 160 hardens prevents the building panel 168 from being subject to any forces or stresses that could cause the building panel to warp and become misaligned as the concrete hardens.

Moreover, the trough assembly 106 is supported by the form assembly 100, which includes support beams 138, 148. In comparison to merely placing an unsupported building panel in a form and pouring concrete around the building panel, the present invention supports the trough assembly 106 such that it remains accurately aligned as possible while the concrete is poured into the form assembly 100 and while the concrete hardens. Specifically, the support beam 138 provides the trough assembly 106 with lateral support and reduces the potential of the trough assembly 106 moving while the concrete is being poured. Moreover, the support beam 138 minimizes the likelihood that the trough assembly 106 will warp while the concrete hardens. Furthermore, the support beams 148 provides the trough assembly 106 with additional lateral support.

A further method of increasing the lateral support of the building panel 168 includes buttressing the portion of the building panel 168 located above the foundation 160. Buttressing the building panel 168 includes adding a support structure 166 to either or both sides of the above building panel 168 and above the trough assembly 106 such that the support structure 166 increases the width of the building panel 168 above and adjacent to the angle irons 124, 126. In other words, the support structure 166 extends trough or abuts the building panel 168 and extends over the trough assembly 106, which is embedded within the concrete foundation 160. An example of such a support structure 166 includes a transverse cross member, such as a steel beam, that extends through both sides of the building panel 168. It may also be preferable to weld the cross member to the building panel 168. Other methods of support structures may include a bracket that is welded, bolted, or etc. to both sides of the building panel 168. Again, buttressing the building panel 168 increases its width, thereby counteracting the moment caused by the lateral forces. Furthermore, buttressing the building panel 168 increases the portion of the building panel 168 that is laterally supported.

It may also be preferable to pour a concrete cap 164 over the support structure 166. Pouring a concrete cap 124 not only creates a useful weight over the support structure 166 but can also increases the depth of the building panel 168 within the concrete foundation 160. As discussed above, increasing the height of the building panel 168 within the trough 162 increases the foundation's ability to impart resistive lateral forces thereon. Thus, pouring a concrete cap 164 over the support structure 166 adjacent the building panel 168 provides a useful advantage. It may be preferable to pour a concrete cap 164 on one side of the building panel 168 or an other concrete cap 170 on the other side of the building panel 168 or both.

Figure 4:
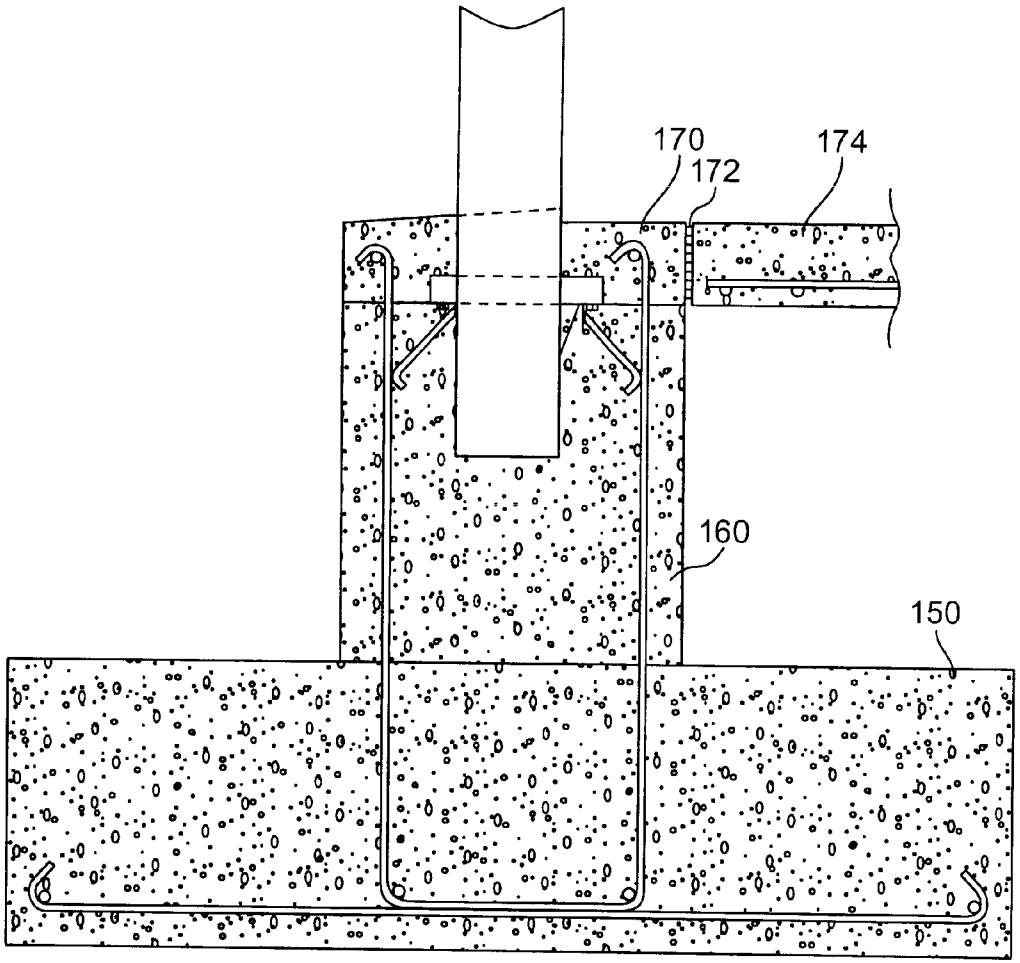
FIG. 4 illustrates an alternate embodiment of the present invention wherein an expansion joint is disposed between the concrete cap and the concrete floor slab.

Assuming that the concrete cap 164 is on the exterior side of the building panel 168 and the other concrete cap 170 is on the interior side of the building panel 168, the concrete cap 170 may be a concrete slab (i.e., floor). Referring to FIG. 4, an alternate embodiment of the present invention includes an expansion joint 172 separating the concrete cap 170' and the concrete slab 174.

Figure 5:
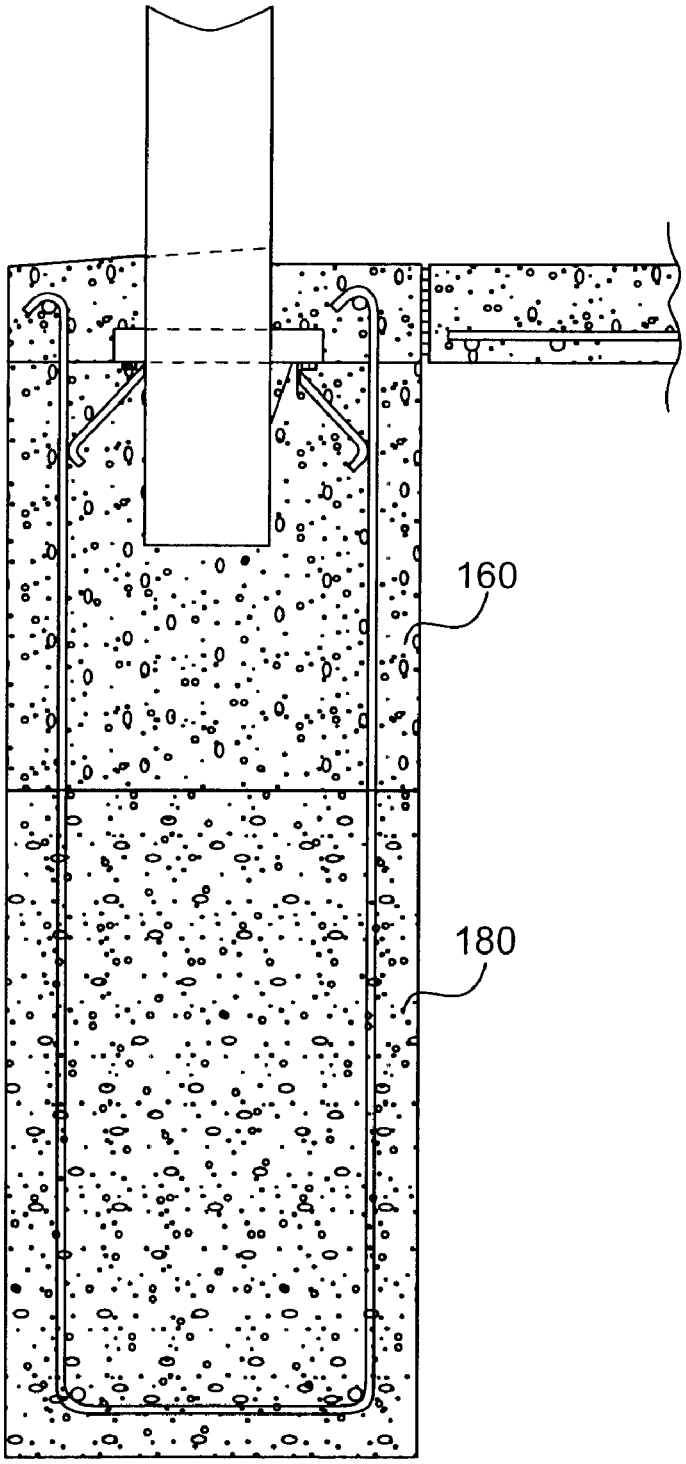
FIG. 5 illustrates another alternate embodiment of the present invention wherein the foundation sits atop a concrete block rather than atop a concrete footing.

Referring to FIG. 5, there is shown an alternate embodiment of the present invention. In comparison to FIG. 4, wherein the foundation 160 sits atop a footing 150 that extends beyond the width of the foundation 160, the foundation 160 in FIG. 5 sits atop a concrete block 180 that is vertically aligned with the foundation 160.

Although the invention has been described and illustrated with respect to the exemplary embodiments thereof, it should be understood by those skilled in the art that the foregoing and various other changes, omissions and additions may be made without departing from the spirit and scope of the invention.

What is claimed is:

1. A method for erecting a building panel, the building panel having two sides and a width, said method comprising the steps of:

(a) forming a foundation having a trough, wherein the width of said base of said trough is approximately equal to the width of said building panel, the step of forming the foundation comprising the steps of:

(i) pouring fluent concrete in a form assembly comprising:

two substantially parallel side panels;

means for preventing said side panels from extending outward;

a trough assembly located between said side panels, said trough assembly comprising:

two elongated upright walls each having a top end and a bottom end;

a base portion connected to said bottom ends of said elongated upright walls; and elongated angle irons aligned with and attached to the top ends of said elongated upright walls, pouring fluent concrete such that the fluent concrete is poured between said trough assembly and said side panels to a level such that at least a portion of said angle irons remain exposed above the concrete; and (ii) allowing said concrete to cure; and (b) placing one end of said building panel within said trough; and (c) connecting said at least one of said angle irons to said building panel.

2. The method of claim 1 wherein the step of connecting at least one of said angle irons to said building panel includes welding at least one of said angle irons to said building panel.

3. The method of claim 1 further comprising the step of inserting a transverse member through either side of said building panel.

4. The method of claim 3 wherein the step of inserting the transverse member includes inserting the transverse member through either side of said building panel and adjacent to the top of the trough.

5. The method of claim 3 further comprising the step of connecting the transverse member to the building panel.

6. The method of claim 5 wherein the step of connecting the transverse member to the building panel includes welding the transverse member to the building panel.

7. The method of claim 3 further comprising the step of pouring a layer of concrete over a portion of said transverse member.

* * * * *